US005584491A

United States Patent [19]

Kronyak, Jr.

[11] Patent Number: 5,584,491

[45] Date of Patent: Dec. 17, 1996

[54] ROLLER SKATE REMOTE BRAKE

[76] Inventor: Dennis P. Kronyak, Jr., 381 Windsor Rd., Woodridge, N.J. 07075

[21] Appl. No.: 438,757

[22] Filed: May 10, 1995

[51] Int. Cl.[6] ..... A63C 17/14

[52] U.S. Cl. ..... 280/11.2; 280/11.22; 188/4 R; 188/2 D

[58] Field of Search ..... 280/11.19, 11.2, 280/11.22, 11.23; 188/4 R, 4 B, 5, 31, 2 D, 68

[56] References Cited

U.S. PATENT DOCUMENTS

| | | | |
|---|---|---|---|
| 4,300,781 | 11/1981 | Riggs | 280/11.2 |
| 4,807,893 | 2/1989 | Huang | 188/5 |
| 5,211,409 | 5/1993 | Mitchell | 280/11.22 |
| 5,251,934 | 10/1993 | Gates | 280/11.2 |
| 5,340,131 | 8/1994 | Smaters | 280/11.22 |
| 5,411,276 | 5/1995 | Moldenhauer | 280/11.2 |
| 5,439,238 | 8/1995 | Neal | 280/11.22 |

*Primary Examiner*—Anne Marie Boehler

[57] ABSTRACT

A brake for remotely decelerating a roller skate. The inventive device includes a brake assembly for engaging and frictionally retarding a wheel of a skate and a ground surface. A cable assembly extends from the brake assembly and terminates in a hand-held actuating assembly for operating the brake assembly through the cable. Securing straps are coupled to the cable assembly for securing the cable to portions of an individual wearing the skate.

1 Claim, 5 Drawing Sheets

ROLLER SKATE REMOTE BRAKE

BACKGROUND OF THE INVENTION

1. Field of the Invention

The present invention relates to braking devices and more particularly pertains to a roller skate remote brake for remotely decelerating a roller skate.

2. Description of the Prior Art

The use of braking devices is known in the prior art. More specifically, braking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art braking devices include U.S. Pat. Nos. 5,312,135; 5,239,941; 4,275,895; 4,312,514; 4,526,389; and 5,067,736.

While these devices fulfill their respective, particular objectives and requirements, the aforementioned patents do not disclose a roller skate remote brake for remotely decelerating a roller skate which includes a brake assembly for engaging and frictionally retarding a wheel of a skate or a ground surface, a cable extending from the brake assembly and terminating in a hand-held actuating assembly for operating the brake assembly through the cable, and securing straps coupled to the cable for securing the cable to portions of an individual wearing the skate.

In these respects, the roller skate remote brake according to the present invention substantially departs from the conventional concepts and designs of the prior art, and in so doing provides an apparatus primarily developed for the purpose of remotely decelerating a roller skate.

SUMMARY OF THE INVENTION

In view of the foregoing disadvantages inherent in the known types of braking devices now present in the prior art, the present invention provides a new roller skate remote brake construction wherein the same can be utilized for remotely decelerating a roller skate. As such, the general purpose of the present invention, which will be described subsequently in greater detail, is to provide a new roller skate remote brake apparatus and method which has many of the advantages of the braking devices mentioned heretofore and many novel features that result in a roller skate remote brake which is not anticipated, rendered obvious, suggested, or even implied by any of the prior art braking devices, either alone or in any combination thereof.

To attain this, the present invention generally comprises a brake for remotely decelerating a roller skate. The inventive device includes a brake assembly for engaging and frictionally retarding a wheel of a skate or a ground surface. A cable assembly extends from the brake assembly and terminates in a hand-held actuating assembly for operating the brake assembly through the cable. Securing straps are coupled to the cable assembly for securing the cable to portions of an individual wearing the skate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roller skate remote brake apparatus and method which has many of the advantages of the braking devices mentioned heretofore and many novel features that result in a roller skate remote brake which is not anticipated, rendered obvious, suggested, or even implied by any of the prior art braking devices, either alone or in any combination thereof.

It is another object of the present invention to provide a new roller skate remote brake which may be easily and efficiently manufactured and marketed.

It is a further object of the present invention to provide a new roller skate remote brake which is of a durable and reliable construction.

An even further object of the present invention is to provide a new roller skate remote brake which is susceptible of a low cost of manufacture with regard to both materials and labor, and which accordingly is then susceptible of low prices of sale to the consuming public, thereby making such roller skate remote brakes economically available to the buying public.

Still yet another object of the present invention is to provide a new roller skate remote brake which provides in the apparatuses and methods of the prior art some of the advantages thereof, while simultaneously overcoming some of the disadvantages normally associated therewith.

Still another object of the present invention is to provide a new roller skate remote brake for remotely decelerating a roller skate.

Yet another object of the present invention is to provide a new roller skate remote brake which includes a brake assembly for engaging and frictionally retarding a wheel of a skate or a ground surface, a cable extending from the brake assembly and terminating in a hand-held actuating assembly for operating the brake assembly the cable, and securing straps coupled to the cable for securing the cable to portions of an individual wearing the skate.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
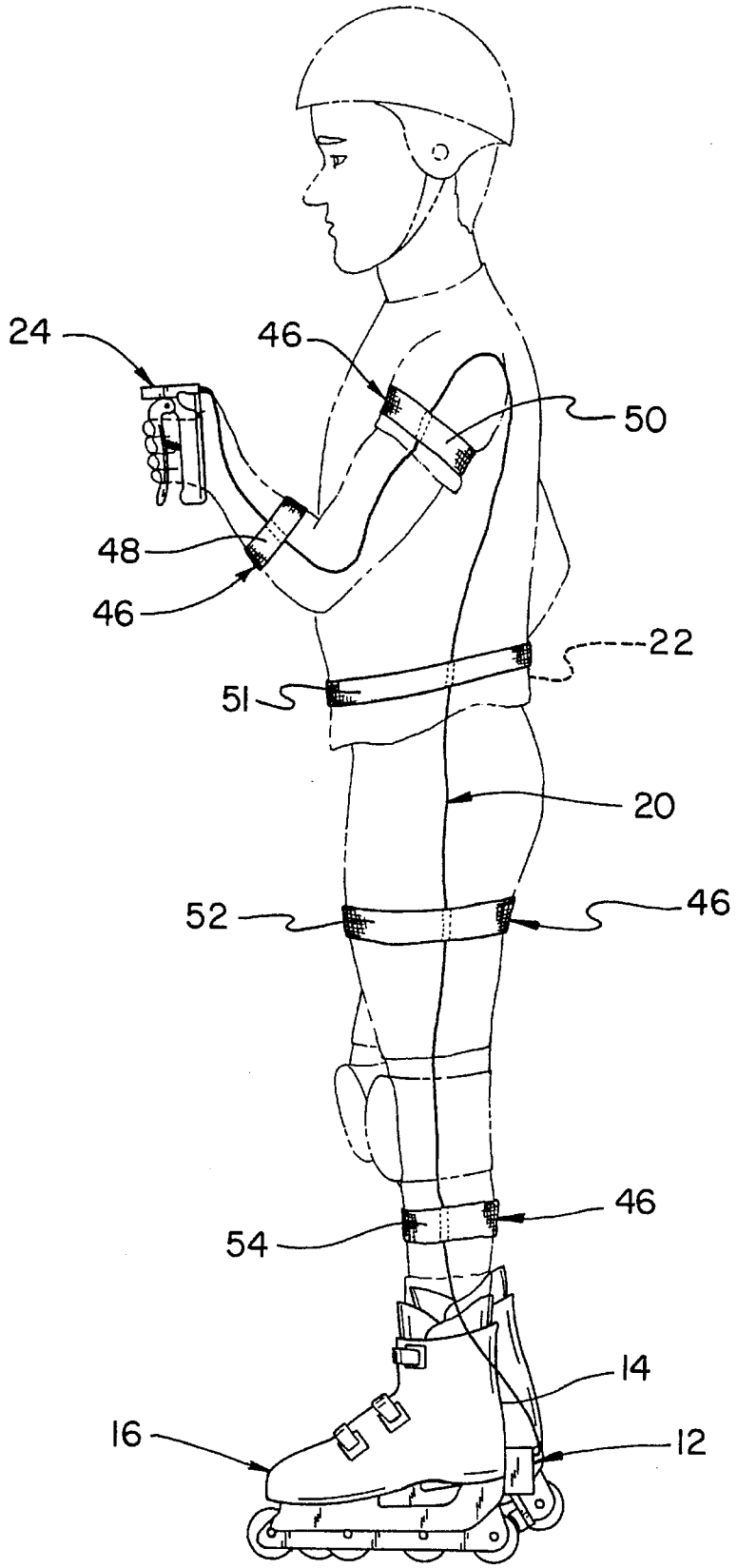
FIG. 1 is a side elevation view of a roller skate remote brake according to the present invention in use.

With reference now to the drawings, and in particular to FIGS. 1–8 thereof, a new roller skate remote brake embodying the principles and concepts of the present invention and generally designated by the reference numeral 10 will be described.

More specifically, it will be noted that the roller skate remote brake 10 comprises a brake means 12 for coupling to a boot 14 of a roller skate 16 and for selectively engaging a wheel 18 of the skate to frictionally retard the wheel against rotation thereof relative to the skate. A cable means 20 mechanically communicates with the brake means 12 for effecting remote actuation of the brake means as desired by an individual 22 during use of the device 10 in conjunction with at least one skate 16 as shown in FIG. 1 of the drawings. An actuating means 24 mechanically communicates with the cable means 20 for effecting manual tensioning of a portion of the cable means 20 to operate the brake means 12. By this structure, the individual 22 utilizing the device 10 can effect manual deceleration of the skate 16 as desired.

Figure 2:
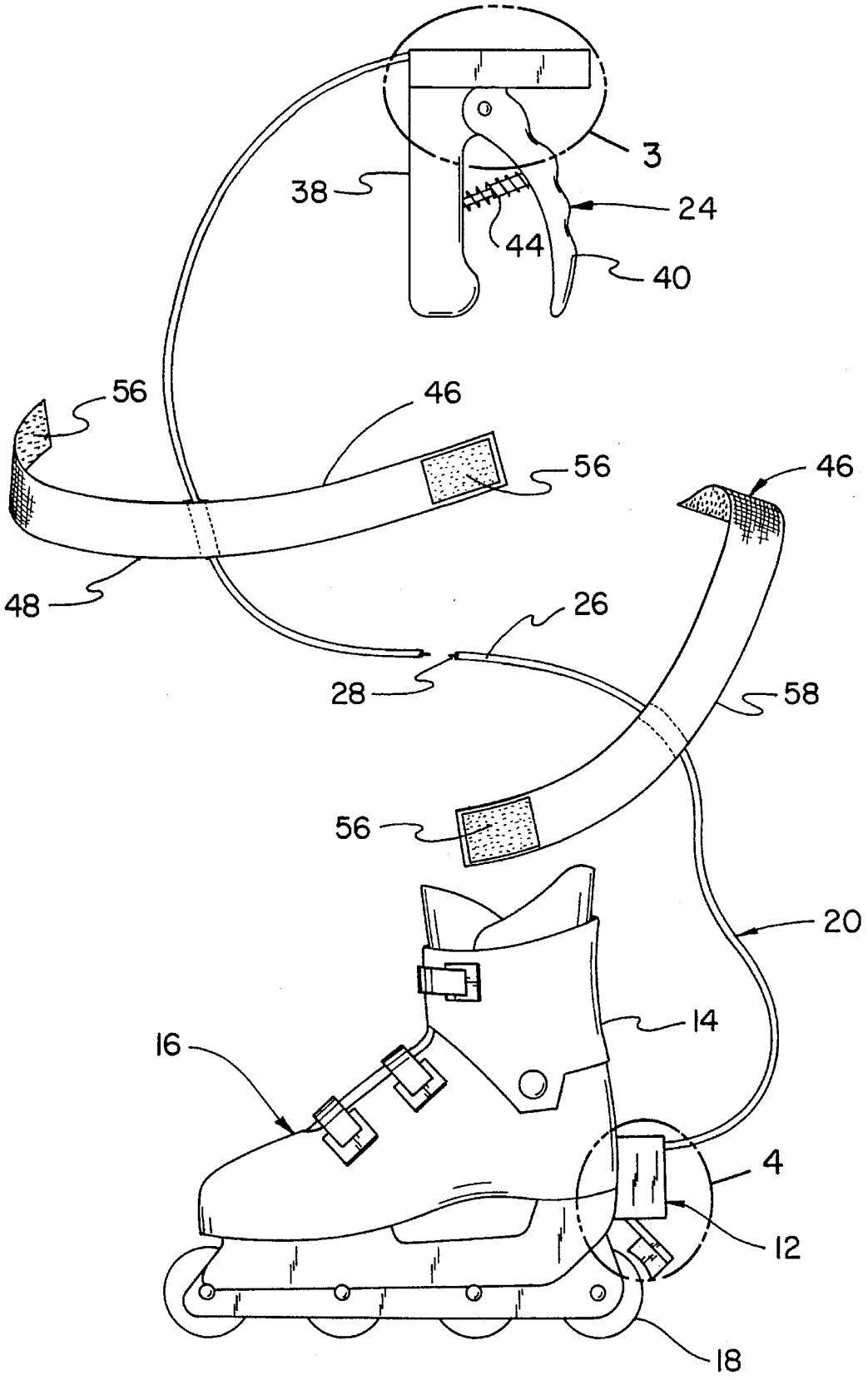
FIG. 2 is an enlarged side elevation view of the invention, per se.
Figure 3:
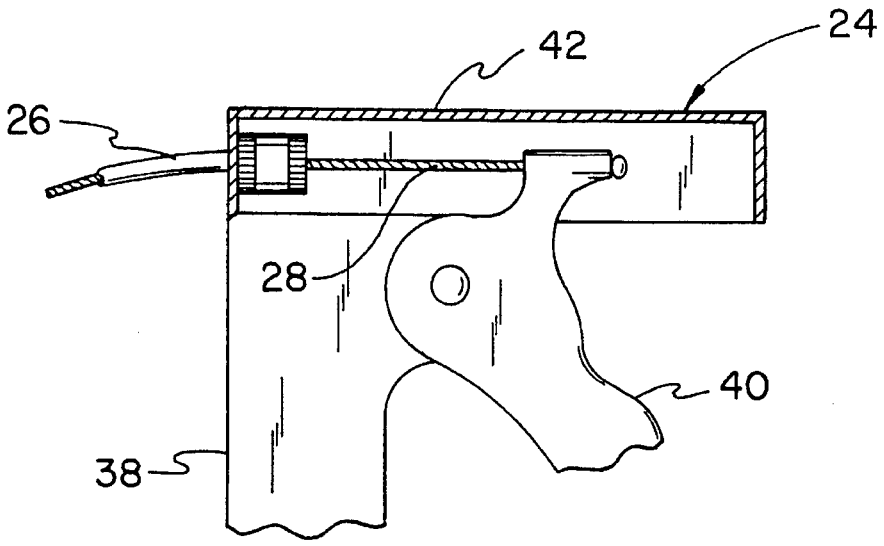
FIG. 3 is an enlarged side elevation view, partially in cross section, of the area set forth in FIG. 2.
Figure 4:
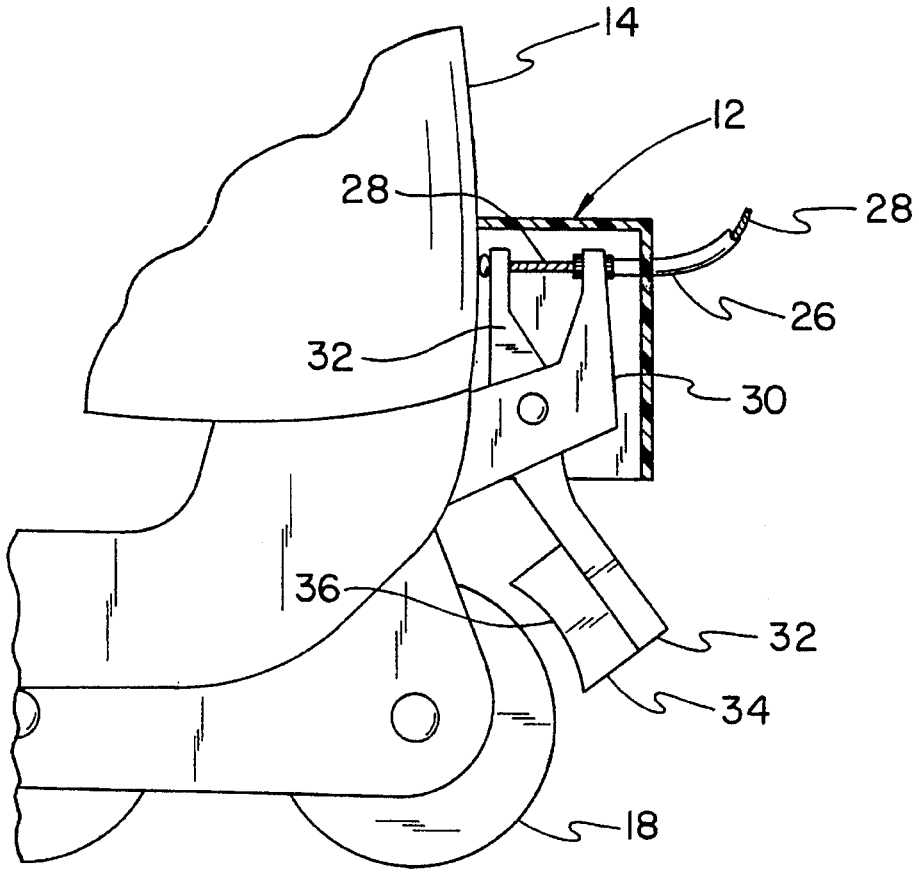
FIG. 4 is an enlarged side elevation view, partially in cross section, of the area set forth in FIG. 2.

As best illustrated in FIGS. 2 through 4, it can be shown that the cable means 20 according to the present invention 10 preferably comprises an elongated cable sheath 26 through which a flexible cable 28 extends. The cable sheath 26 thus permits the flexible cable 28 to be tensioned therewithin to effect operation of the brake means 12.

As shown in FIG. 4, the brake means 12 according to the present invention 10 preferably comprises a mounting bracket 30 securable to a rear portion of the boot 14 of a skate 16. A brake arm 32 is pivotally mounted relative to the mounting bracket 30 and extends into close proximity relative to the wheel 18 of the skate 16. A wheel brake pad 34 is mounted to a lower portion of the brake arm 32 and includes an arcuate engaging surface 36 cooperable with an exterior perimeter of the wheel 18 such that engagement of the wheel brake pad 34 with the wheel 18 will effect frictional retarding of the wheel to decelerate the skate 16. An upper portion of the brake arm 32 is coupled to the cable 28 of the cable means 20, with the cable sheath 26 of the cable means being secured to a portion of the mounting bracket 30. By this structure, a tensioning of the cable 28 will cause the upper portion of the brake arm 32 to be pulled towards the mounting bracket 30 to effect engagement of the wheel brake pad 34 against the wheel 18 to decelerate the wheel.

Figure 5:
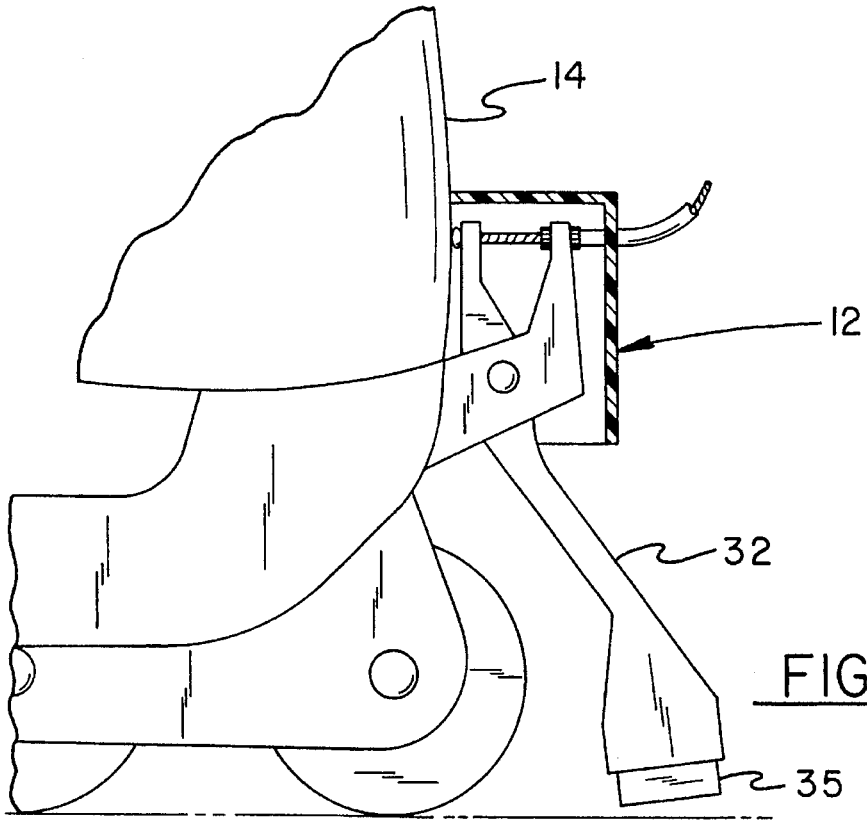
FIG. 5 is a side elevational view, partially in cross section, of an alternative form of a brake means comprising a portion of the present invention.
Figure 6:
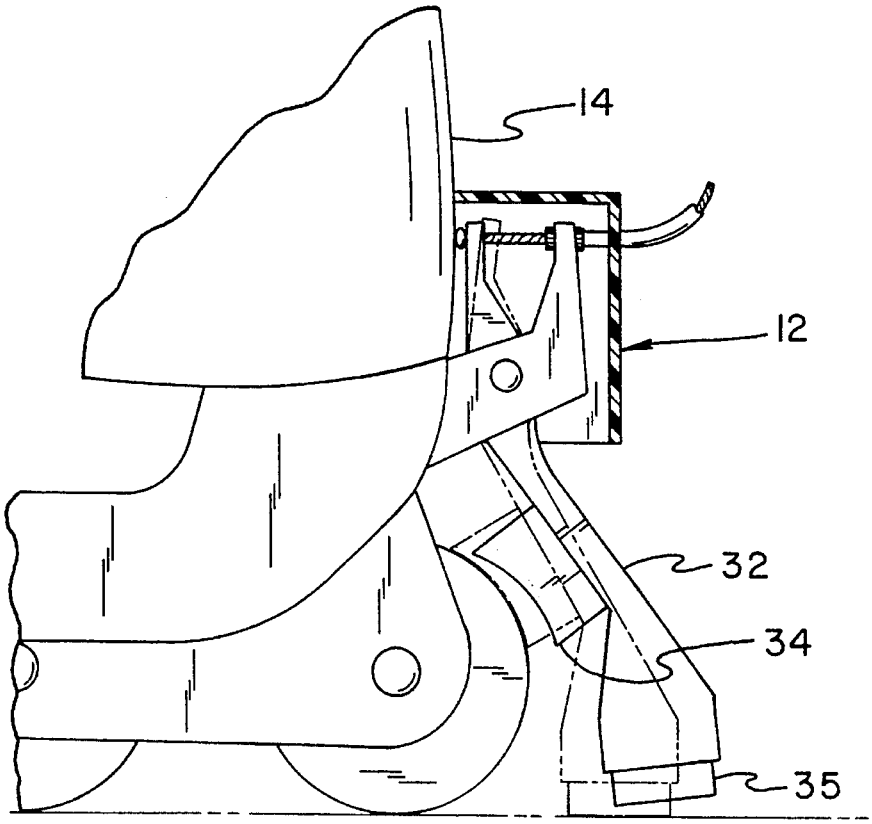
FIG. 6 is a side elevational view, partially in cross section, of a further alternative form of the brake means.

As shown in FIGS. 5 and 6, the brake means 12, in lieu of the wheel brake pad 34, may alternatively comprise a ground brake pad 35 coupled to the brake arm 32 for contacting a ground surface beneath the skate 16. FIG. 6 illustrates both the wheel brake pad 34 and the ground brake pad 35 coupled to the brake arm 32 for simultaneously engaging both the wheel 18 of the skate 16 and the ground surface therebeneath.

As best illustrated in FIGS. 2 and 3, it can be shown that the actuating means 24 according to the present invention 10 preferably comprises a fixed handle 38 which can be grasped and manipulated by the individual 22 during use of the device 10. The cable sheath 26 of the cable means 20 is secured to the fixed handle 38. A pivoting handle 40 is pivotally mounted to an upper portion of the fixed handle 38 and engages the cable 28 of the cable means 20. By this structure, a rotation of the pivoting handle 40 relative to the fixed handle 38 will effect tensioning of the cable 28 within the cable sheath 26 to actuate the brake means 12 as described above. A housing 42 preferably extends from the fixed handle 38 so as to enclose the cable 28 within the actuating means 24. As shown in FIG. 2, a spring return mechanism 44 extends between the fixed handle 38 and the pivoting handle 40 to resiliently bias the pivoting handle 40 from the fixed handle.

As shown in FIG. 1, the present invention 10 may further comprise securing means 46 for securing the cable means 20 to portions of a body of the individual 22. To this end, the securing means 46 preferably comprises a forearm strap 48 secured to the cable sheath 26 and extendable about a forearm of the individual 22, an upper arm strap 50 secured to the cable sheath and extendable about an upper arm of the individual, a waist strap 51 coupled to the cable sheath and extendable about a waist of the individual, a thigh strap 52 secured to the cable sheath and extendable about a thigh of the individual, and a lower leg strap 54 secured to the cable sheath and extendable about a lower leg of the individual. As shown in FIG. 2 for the forearm strap 48 and the lower leg strap 54, the securing means 46 includes a hook and loop material 56 for securing the straps 48–54 about the limbs of the individual 22. By this structure, the cable means 20 can be secured relative to the individual 22 to preclude an unintentional engagement of the cable means 20 with surrounding objects during use of the device 10.

Figure 7:
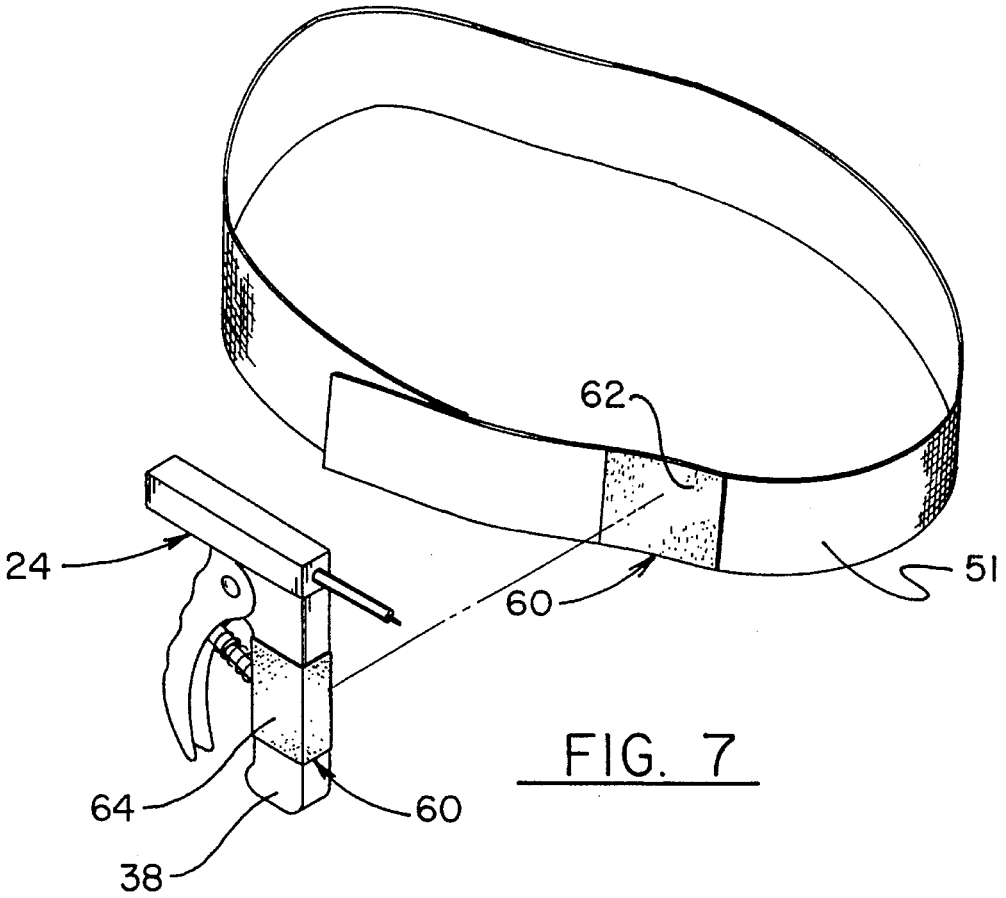
FIG. 7 is an exploded isometric illustration of the invention including a handle securing means.
Figure 8:
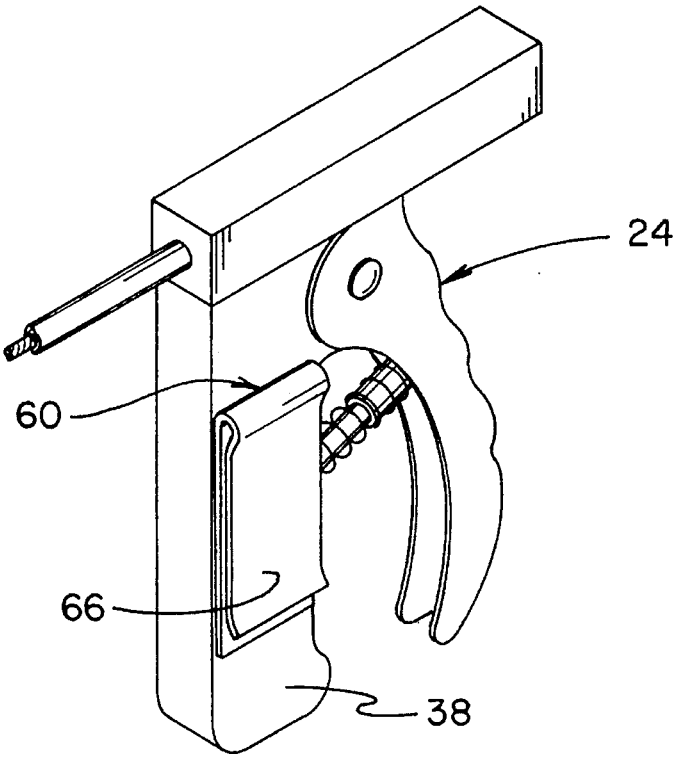
FIG. 8 is an isometric illustration of an alternative form of the handle securing means.

Referring now to FIGS. 7 and 8, it can be shown that the present invention 10 may further comprise a handle mounting means 60 for coupling the actuator means 24 to one of the straps 48–54 of the securing means 46. To this end, the handle mounting means 60, as shown in FIG. 7, may comprise a strap portion 62 of hook and loop fabric fastening material secured to the waist strap 51 of the securing means 46. A handle portion 64 of hook and loop fabric fastening material is coupled to the handle 38 of the actuating means 24 and is preferably wrapped circumferentially thereabout. The portions 62 and 64 of the fabric fastening material can thus be cooperatively engaged to removably secure the actuating means 24 to the waist strap 51. Alternatively, the handle mounting means 60, in lieu of the hook and loop fabric fastening portions 62 and 64, may comprise a belt clip 66 secured to the handle of the actuating means 24 which can be engaged to one of the straps 48–54 of the securing means 46, such as the waist strap 51.

In use, the roller skate remote brake 10 according to the present invention can be easily utilized to effect deceleration of a skate 16 by an individual 22 wearing the skate. Because the cable means 20 can be secured relative to the individual 22, the present invention 10 substantially reduces a chance of unintentional engagement of the cable means 20 with surrounding objects and serves to increase safety of the individual 22 during a skating procedure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A roller skate remote brake comprising:

a brake means for coupling to a boot of a roller skate for frictionally retarding the skate relative to a ground surface, the brake means comprises a mounting bracket securable to a rear portion of the boot of the roller skate, a first brake arm pivotally mounted relative to the mounting bracket and extendable into close proximity to a wheel of the skate, a second brake arm mounted relative to the mounting bracket and extendable into close proximity relative to a ground surface, a wheel brake pad mounted to a lower portion of the first brake arm and positioned to engage a rear wheel of the skate, a ground brake pad mounted to a lower portion of the second brake arm and positioned to engage the ground surface;

a cable means positioned in mechanical communication with the brake means for effecting remote actuation of the brake means, wherein the upper portions of the first and second brake arm are coupled to the cable means;

an actuating means positioned in mechanical communication with the cable means for effecting manual tensioning of the cable means to operate the brake means, the actuating means comprises a fixed handle which can be grasped and manipulated by an individual, the cable means being secured to the fixed handle, a pivoting handle pivotally mounted to an upper portion of the fixed handle, the cable means being secured to the pivoting handle such that rotation of the pivoting handle relative to the fixed handle will effect tensioning of the cable means to actuate the first and second brake arms of the brake means;

and, securing means for securing the cable means to portions of a body of an individual.

* * * * *